United States Patent [19]

Hareland

[11] 4,257,025

[45] Mar. 17, 1981

[54] LAMINATED METALLIC PLATES FOR SUPPORTING CORE LEG IN INDUCTIVE ELECTRICAL DEVICES TO DETERMINE MAGNETIC CIRCUIT

[75] Inventor: Ingvar Hareland, Ludvika, Sweden

[73] Assignee: ASEA Aktiebolag, Vesteras, Sweden

[21] Appl. No.: 47,643

[22] Filed: Jun. 11, 1979

[30] Foreign Application Priority Data

Jun. 12, 1978 [SE] Sweden ..... 7806753

[51] Int. Cl.[3] ..... H01F 27/24

[52] U.S. Cl. ..... 336/84 M; 336/178; 336/212; 336/219

[58] Field of Search ..... 336/84 R, 84 M, 212, 336/219, 234, 178

[56] References Cited

U.S. PATENT DOCUMENTS

| | | | |
|---|---|---|---|
| 3,195,087 | 7/1965 | Welch | 336/84 R |
| 3,750,070 | 7/1973 | Rissinger | 336/84 M |
| 3,821,677 | 6/1974 | Boaz | 336/84 M |
| 3,983,523 | 9/1976 | Ayers | 336/84 R |

FOREIGN PATENT DOCUMENTS

| | | | |
|---|---|---|---|
| 2728905 | 1/1979 | Fed. Rep. of Germany | 336/84 M |
| 442715 | 2/1936 | United Kingdom | 336/212 |
| 835147 | 5/1960 | United Kingdom | 336/212 |
| 1174587 | 12/1969 | United Kingdom | 336/234 |

*Primary Examiner*—Thomas J. Kozma

*Attorney, Agent, or Firm*—Watson, Cole, Grindle & Watson

[57] ABSTRACT

A magnetic circuit for inductive electrical devices, preferably reactors, comprises a frame consisting of yokes and side walls, the frame having a preferably rectangular cross-section and being manufactured from laminated magnetic material. At least one core leg having a preferably circular cross-section and composed of laminated magnetic material is arranged in the frame between the two yokes. Between the ends of the core leg and the yokes are arranged cross-flux plates of laminated magnetic material in order to distribute the flux between the legs and yokes. The laminations in the cross-flux plates are oriented to be perpendicular to the laminations in the yokes. Each cross-flux plate covers at least the full width of the yoke and at least the complete width of the core leg. The width of each plate is suitably as great as the diameter of the winding which is arranged around the core leg. Each plate will thus act as a mechanical support for the ends of the winding. It is suitable to arrange spacers of non-magnetic material between the end of the core leg and each plate and between each plate and the adjacent yoke.

4 Claims, 2 Drawing Figures

LAMINATED METALLIC PLATES FOR SUPPORTING CORE LEG IN INDUCTIVE ELECTRICAL DEVICES TO DETERMINE MAGNETIC CIRCUIT

BACKGROUND OF THE INVENTION

The present invention relates to a magnetic circuit for inductive electrical devices. Such inductive electrical devices include both reactors and transformers.

Inductive electrical devices such as reactors and transformers contain a core of laminated, soft-magnetic sheet which forms one or more closed magnetic circuits for the magnetic flux. The core consists of two yokes with legs arranged between the yokes, around which legs windings are arranged. When the core (preferably in reactors) is made in the form of a frame of straight sheet strips, it is generally desirable that this frame in layer upon layer have the same width in all the frame parts, so that the magnetic flux is able to easily run around in the frame without having to be redistributed between different layers by passage from layer to layer. Such cross-passage of flux means that the flux will have to pass through plane sheet surfaces, which causes great additional losses at the sheet surfaces and causes undesirable heating of the core.

In certain cases, however, it is possible for mechanical reasons to construct the different parts of the core with different shapes of cross-sectional area in spite of the fact that the cross sectional area is maintained substantially constant. It may thus be desirable to make the core leg with substantially round cross-section in order for it to be better surrounded by a circular winding coil, whereas the yokes are constructed with a rectangular cross-section.

SUMMARY OF THE INVENTION

The present invention offers a possibility of performing such a construction without difficulties arising as regards the redistribution of the flux across the direction of lamination. According to the invention, this is done by introducing what is here called cross-flux plates, which are arranged between the ends of the core leg and the yokes. These cross-flux plates include laminations of magnetic sheets which extend perpendicularly to the laminations in the yokes, and which extend at least the width of the core leg and suitably the diameter of the winding around the core leg.

The invention will be better understood by a review of the attached drawing and the following related explanation.

DETAILED DESCRIPTION OF A PREFERRED EMBODIMENT

Figure 1:
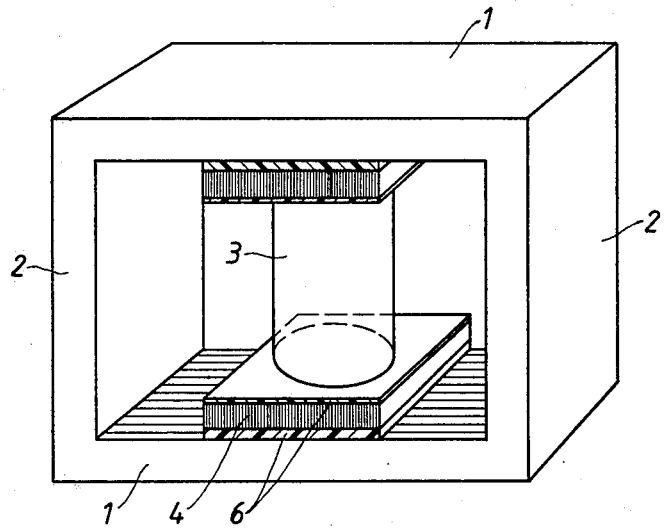
FIG. 1 depicts a perspective view of an electrical reactor core.

The electrical reactor core depicted in FIG. 1 consists of a square frame (formed of multiple laminations as indicated) having a rectangular cross-section with a core leg in the middle, the core leg having a circular cross-section and being wrapped by a winding (not shown) in a conventional fashion. The frame includes upper and lower yokes 1 which are connected together via side walls 2, and the core leg 3 is positioned to extend between the upper and lower yokes. The yokes and side walls are constructed so as to have a rectangular cross-section, the larger side of which is longer than the diameter of the core leg and the smaller side of which is smaller than half the larger side; however, the dimensions are such that the cross-sectional area of the yoke frame 1, 2 approximately corresponds to half the cross-sectional area of the core leg 3 (if the yoke frame ideally corresponded to the round cross-section of the core leg, the yoke frame would have an elliptic sectional configuration with the ratio 1:2 between the minor and major axes). The section of the yoke should still be uniformly utilized with a constant flux density.

Figure 2:
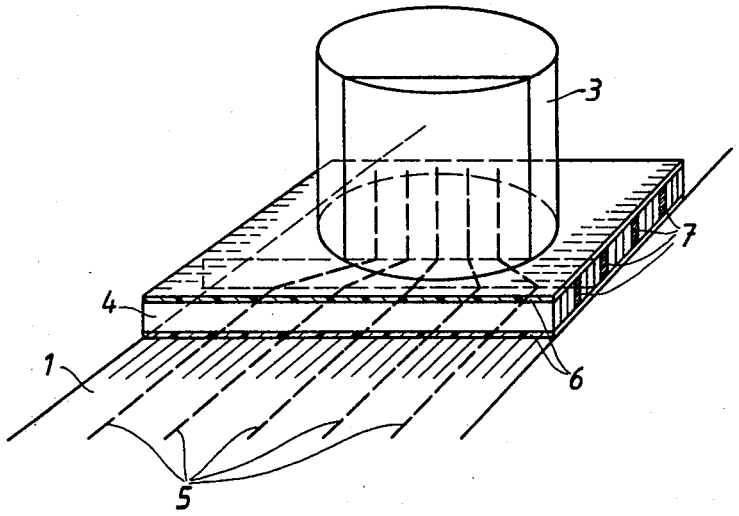
FIG. 2 schematically shows the magnetic flux lines at one end of the core leg.

In order to obtain the uniform, constant flux density, a plate 4 of laminated magnetic sheets is positioned between the yokes 1, 1 and the ends of the leg 3, the sheets standing on edge and being oriented such that their longitudinal dimension extends across (perpendicular to) the multiple laminations which form the yoke. The plate is formed to cover at least the full width of the yoke. The flux is thus able to pass over all the sheets in the yoke to all the sheets in the cross flux plate and then up into the core leg. In both cases the flux passes out and in to the sheets through the cutting edges and not through the side surfaces. In this way the flux can be redistributed between the rectangular section of the yoke and the round section of the core leg by running to a necessary extent across the longitudinal direction of the yoke in the sheets in the cross-flux plate, i.e., as shown in FIG. 2. The flux is shown in FIG. 2 by coarse dashed lines 5.

In order to obtain a good redistribution of the flux, it is advantageous to locate uniform air gaps between the core leg and the plate, as well as between the plate and the adjacent yoke. This can be created, for example, by locating spaces 6, formed of a non-magnetic material, at these locations. Furthermore, it is acceptable to construct the plate so that a possible passage of flux across the lamination in the plate will be rendered difficult, and according to this invention such can be achieved by inserting non-magnetic spacers 7 in a suitable manner between groups of the metallic sheets. The number of such spacers and their mutual positioning within the cross-flux plate is determined on a case by case basis as these variables are dependent on both geometrical and magnetic conditions of the particular installation.

To manage the redistribution of magnetic flux between the core leg and the yoke the width of the plate 4 need be only insignificantly greater than the diameter of the core leg. However, the plate may also be given a mechanical function, i.e., that axially supporting the winding around the core leg. This results in a simplification of the mechanical construction of the reactor since the press forces on the winding column are then transmitted directly to the yoke frame instead of being absorbed by brackets extending from the press flanges of the yokes (which are normally used in reactors and transformers). The plane surface of the plate(s) is then extended to cover substantially the end surface of the winding. The plate will then act in a manner known per se as a magnetic shunt and intercept the leakage flux within the winding section and conduct it into the yoke. In this way the leakage flux will be prevented from spreading to surrounding constructional parts, such as press flanges and the tank, where it would cause losses.

While there has been shown and described what is considered to be some preferred embodiments of the present invention, it will be obvious to those skilled in the art that various changes and modifications may be made therein without departing from the invention as defined in the appended claims.

I claim:

1. In an inductive electrical device which includes a main magnetic circuit having spaced apart laminated magnetic yokes of substantially rectangular cross-section and at least one magnetic core leg positioned therebetween, each said core leg being of substantially circular cross-section and being wrapped with a winding, the improvement wherein a separate cross-flux plate is positioned between the opposite ends of each said core leg and the adjacent yoke, each cross-flux plate comprising laminations of elongated magnetic sheets which extend in a direction substantially perpendicular to the direction of laminations of said yokes and such that each plate covers at least the cross-section of said core leg and the width of said respective yoke.

2. A device according to claim 1 including first means for providing separate first air gaps between each cross-flux plate and the adjacent yoke, and including second means for providing separate second air gaps between each cross-flux plate and the end of the adjacent core leg.

3. A device according to claim 1 wherein each said cross-flux plate includes non-magnetic spacer means located between predetermined numbers of elongated magnetic sheets therein.

4. A device according to claim 1 wherein said cross-flux plates are of such dimensions as to substantially cover the end surfaces of the windings and thus serve as an axial mechanical support therefor.

* * * * *